US009163597B2

(12) United States Patent
Manubolu et al.

(10) Patent No.: US 9,163,597 B2
(45) Date of Patent: Oct. 20, 2015

(54) HIGH-PRESSURE CONTAINMENT SLEEVE FOR NOZZLE ASSEMBLY AND FUEL INJECTOR USING SAME

(75) Inventors: Avinash Manubolu, Edwards, IL (US); Stephen Lewis, Chillicothe, IL (US)

(73) Assignee: Caterpillar Inc., Peoria, IL (US)

( * ) Notice: Subject to any disclaimer, the term of this patent is extended or adjusted under 35 U.S.C. 154(b) by 1250 days.

(21) Appl. No.: 12/286,712

(22) Filed: Oct. 1, 2008

(65) Prior Publication Data

US 2010/0078504 A1 Apr. 1, 2010

(51) Int. Cl.

*F02M 41/16* (2006.01)
*F02M 47/02* (2006.01)
*F02M 61/16* (2006.01)

(52) U.S. Cl.

CPC ..... *F02M 47/027* (2013.01); *F02M 61/168* (2013.01)

(58) Field of Classification Search

CPC ... F02M 47/027; F02M 61/168; F02M 47/00; F02M 47/02
USPC ..... 239/88, 96, 533.9–533.12, 239/533.1–533.3, 585.1
See application file for complete search history.

(56) References Cited

U.S. PATENT DOCUMENTS

| | | | | |
|---|---|---|---|---|
| 3,442,451 | A | 5/1969 | Nagel | |
| 3,598,314 | A | 8/1971 | Bailey et al. | |
| 3,788,546 | A | 1/1974 | Bailey et al. | |
| 4,034,914 | A * | 7/1977 | Richter | 239/96 |
| T983,006 | I4 | 6/1979 | Bailey et al. | |
| 4,200,231 | A | 4/1980 | Knape | |
| 4,572,433 | A * | 2/1986 | Deckard | 239/88 |
| 4,798,186 | A | 1/1989 | Ganser | |
| 5,687,693 | A | 11/1997 | Chen et al. | |
| 5,954,033 | A | 9/1999 | Moncelle | |
| 6,293,254 | B1 | 9/2001 | Crofts et al. | |
| 6,499,669 | B2 | 12/2002 | Ganser | |
| 6,637,675 | B2 * | 10/2003 | Carroll et al. | 239/533.4 |
| 6,705,551 | B1 | 3/2004 | Kienzler et al. | |
| 6,928,985 | B2 | 8/2005 | Boecking | |
| 7,021,558 | B2 | 4/2006 | Chenanda et al. | |
| 7,121,476 | B2 | 10/2006 | Buehler et al. | |
| 7,320,310 | B2 | 1/2008 | Eisenmenger et al. | |
| 8,128,005 | B2 * | 3/2012 | Magel | 239/96 |
| 2002/0134853 | A1 | 9/2002 | Stoecklein et al. | |
| 2004/0007210 | A1 | 1/2004 | Tian et al. | |
| 2004/0026839 | A1 | 2/2004 | Schmieder et al. | |
| 2005/0263135 | A1 | 12/2005 | Magel et al. | |
| 2007/0101968 | A1 * | 5/2007 | Gibson et al. | 123/300 |
| 2007/0272213 | A1 | 11/2007 | Gibson | |

FOREIGN PATENT DOCUMENTS

| | | | |
|---|---|---|---|
| JP | 10002261 | | 1/1998 |
| JP | 10184486 | | 7/1998 |
| WO | WO2008/110406 | * | 9/2008 |

* cited by examiner

*Primary Examiner* — Christopher Kim

(57) ABSTRACT

A nozzle assembly for a fuel injector capable of withstanding high-pressures includes a nozzle chamber defined by a high-pressure containment sleeve, a tip component defining a nozzle outlet, and an injector stack component. A leakage path is defined between an injector body casing and an outer wall surface of the high-pressure containment sleeve and a needle valve member that opens and closes the nozzle outlet is out of contact with the high-pressure containment sleeve. The high-pressure containment sleeve has a hollow, cylindrical shape and has an inner wall exposed to fluid pressure inside the nozzle chamber that is free of stress concentrating surface features associated with heart shaped cavities in the prior art.

10 Claims, 2 Drawing Sheets

HIGH-PRESSURE CONTAINMENT SLEEVE FOR NOZZLE ASSEMBLY AND FUEL INJECTOR USING SAME

TECHNICAL FIELD

The present disclosure relates generally to nozzle assemblies in fuel injectors, and in particular, to nozzle assemblies including a pressure containment system.

BACKGROUND

Manufacturers of fuel injectors are continuously trying to raise the injection pressure of fuel to reduce undesirable emissions as well as improve fuel efficiency in engines. However, due to geometrical limitations and spatial constraints in smaller fuel injectors, structural problems may prevent the fuel injectors from sustaining pressures above 200 MPa. Currently, the nozzle assembly of fuel injectors defines a heart shaped cavity formed in a metallic tip to contain the pressure inside the nozzle assembly.

U.S. Pat. No. 7,331,329 ('329 patent) discusses improving fuel efficiency by reducing static leakage by connecting a spring chamber to a common rail instead of to a low pressure vent. FIG. 4 of the '329 patent illustrates an embodiment of a nozzle assembly without the type of heart shaped cavity inside the fuel injector that is typical in the art.

The present disclosure is directed to overcoming one or more of the problems set forth above.

SUMMARY

In one aspect a nozzle assembly includes a tip component defining a nozzle outlet. A high-pressure containment sleeve is disposed within an injector body casing. The high-pressure containment sleeve and the tip component partially define a nozzle chamber. A needle valve member is movable between a first position that closes the nozzle outlet and a second position that opens the nozzle outlet. The needle valve member includes an opening hydraulic surface exposed to fluid pressure in the nozzle chamber. The needle valve member is out of contact with the high-pressure containment sleeve.

In another aspect, a fuel injector includes an injector body, which includes a tip component that defines a nozzle outlet and a high-pressure containment sleeve disposed within an injector body casing. The high-pressure containment sleeve and the tip component partially define a nozzle chamber. The fuel injector also includes a needle valve member that is disposed within the injector body and movable between a first position that closes the nozzle outlet and a second position that opens the nozzle outlet. The needle valve member includes an opening hydraulic surface exposed to fluid pressure in the nozzle chamber. The needle valve member also includes a closing hydraulic surface that is exposed to fluid pressure in a needle control chamber. The needle valve member is out of contact with the high-pressure containment sleeve, and a control valve assembly is fluidly connected to the needle control chamber.

In yet another aspect, a method of operating a fuel injector includes a step of forming a nozzle chamber within a high-pressure containment sleeve. The method also includes the step of containing pressure inside the nozzle chamber with a wall thickness of the high-pressure containment sleeve. The method also includes sealing the nozzle chamber by sizing annular sealing lands between the high-pressure containment sleeve and a tip component and an injector stack component, respectively, to have radial widths smaller than the wall thickness of the high-pressure containment sleeve. The method also includes exposing an opening hydraulic surface of a needle valve member to fluid pressure inside the nozzle chamber, and maintaining the high-pressure containment sleeve out of contact with the needle valve member.

DETAILED DESCRIPTION

The present disclosure relates to a nozzle assembly of any fuel injector that incorporates a high-pressure containment sleeve that partially defines a nozzle chamber. In the past, nozzle assemblies included a heart shaped cavity, which was surrounded by a metallic wall of a tip component. As the pressures inside fuel injectors are increased to achieve better emissions and fuel efficiency, the metallic wall of the heart shaped cavity of the nozzle assemblies may form cracks and stress fractures. The heart shaped cavity may only become problematic in small injectors with inadequate wall thickness at higher pressures. Larger fuel injectors may not experience the formation of cracks and stress fractures in the walls of the heart shaped cavity because there is ample space inside the fuel injector to increase the wall thickness of the metallic wall that defines the heart shaped cavity. The present disclosure replaces the heart shaped cavity by introducing a high-pressure containment sleeve, which will allow smaller fuel injectors to sustain fuel pressures over 200 MPa without experiencing stress fractures. Further, the present disclosure is pertinent to all types of fuel injectors including common rail, hydraulic and cam actuated fuel injectors as well as fuel injectors of varying sizes. For the sake of simplicity, a common rail fuel injector is described. However, various types of fuel injectors incorporating the nozzle assembly described herein all fall within the scope of this disclosure. The present disclosure describes a nozzle assembly, which replaces a heart-shaped cavity design with a high-pressure containment sleeve.

Figure 1:
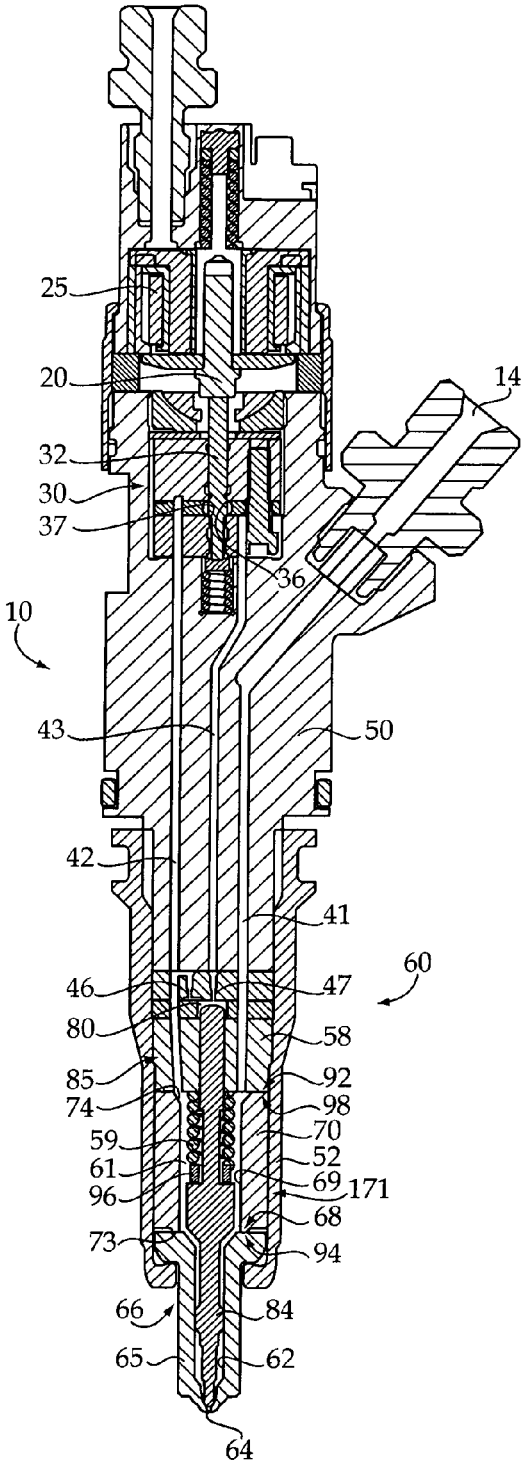
FIG. 1 shows a front sectioned view of a fuel injector.
Figure 2:
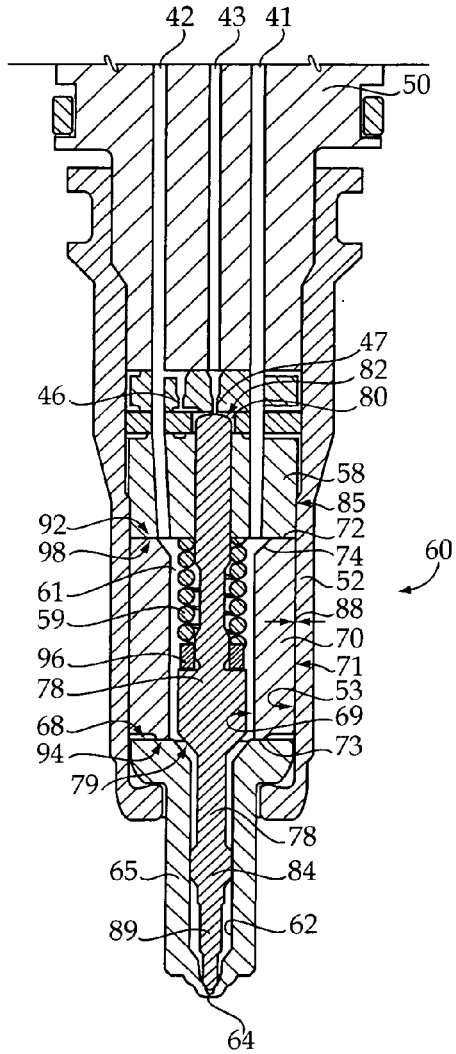
FIG. 2 shows an enlarged front sectioned view of a nozzle assembly of the fuel injector in FIG. 1.

Referring to FIGS. 1 and 2, a fuel injector 10 includes an injector body 50 having an injector body casing 52, a nozzle assembly 60, a control valve assembly 30 and an armature assembly 20 that moves under the action of a solenoid coil 25. The nozzle assembly 60 includes a high-pressure containment sleeve 70, which is disposed within the injector body casing 53, and is in sealed contact with an injector stack component 85 and a tip component 65. The high-pressure containment sleeve 70, the injector stack component 85 and the tip component 65 define a nozzle chamber 61, in which a needle valve member 78 is movably positioned. In one embodiment, a nozzle spring 59 biases the needle valve member 78 to a closed position. A nozzle spring spacer 96 may set a preload on the nozzle spring 59.

The high-pressure containment sleeve 70 has an outer wall surface 71, an inner wall surface 69, a top surface 92 and a bottom surface 94. The high-pressure containment sleeve 70 has a hollow, cylindrical shape, which means the high-pressure containment sleeve 70 is cylindrical in shape and has a hollow interior bore through the top and bottom surfaces 92 and 94 of the high-pressure containment sleeve 70. The high-pressure containment sleeve has a wall thickness defined by the difference between the radius of the outer wall surface 71 and the radius of the inner wall surface 69 of the high-pressure containment sleeve 70. The wall thickness of the high-pressure containment sleeve 70 is designed to accommodate expected hoop stresses from expected pressure levels in the high-pressure containment sleeve 70. Those skilled in the art appreciate that hoop stress may be the greatest towards the mid-section of the high-pressure containment sleeve 70, therefore, the thickness of the high-pressure containment sleeve 70 is determined from the thickness at the mid-section of the high-pressure containment sleeve 70. Although the thickness of the high-pressure containment sleeve 70 may vary throughout its length, it may be easier to manufacture a high-pressure containment sleeve 70 with a uniform thickness. In one embodiment, the high-pressure containment sleeve 70 has a uniform wall thickness along a majority of the length of the high-pressure containment sleeve 70, which means that the wall thickness remains the same for more than half of the length of the high-pressure containment sleeve 70.

The high-pressure containment sleeve 70 includes an upper sealing land 72 located on the top surface 92 of the high-pressure containment sleeve 70 and a lower sealing land 73 located on the bottom surface 94 of the high-pressure containment sleeve 70. The upper and lower sealing lands 72 and 73 may be annular, and have a radial surface width smaller than the thickness of the wall of the high-pressure containment sleeve 70. The term radial surface width is defined as the difference between the radius of an outer edge of the sealing land and the radius of an inner edge of the sealing land. Those skilled in the art may appreciate that by having the radial surface width of the sealing lands 72 and 73 smaller than the wall thickness of the high-pressure containment sleeve 70, the clamping pressure acting on the sealing lands 72 and 73 will be greater, therefore, producing better sealing. The top surface 92 and the bottom surface 94 of the high-pressure containment sleeve 70 may have chamfers 74, or some other surface contour, which also result in the sealing lands 72 and 73 having a smaller radial surface width compared to the wall thickness at the mid-section of the high-pressure containment sleeve 70. The bottom surface 94 of the high-pressure containment sleeve 70 and a top surface 68 of the tip component 65 are in contact and form a seal to prevent fluid from leaking out of the nozzle chamber 61.

The outer wall surface 71 of the high-pressure containment sleeve 70 is separated from the inner wall 53 of the injector body casing 52 by a space, which may be referred to as a leakage path 88. The leakage path 88 runs along the inner wall 53 of the injector body casing 52 into a drain outlet port (not shown) of the fuel injector 10.

In addition to the high-pressure containment sleeve 70, the nozzle assembly 60 includes the tip component 65 that includes an outer wall 66, a top surface 68, a bottom end 67, which defines a nozzle outlet 64. A bore 62 is defined within the tip component 65 and runs from the top surface 68 of the tip component 65 towards the bottom end 67 of the tip component 65, where it opens up into the nozzle outlet 64. The tip component 65 is partially disposed within the injector body casing 52, and the outer wall 66 of the tip component 65 may form a sealing contact 56 with the injector body casing 52, preventing any fuel that enters into the leakage path 88 to escape from between the inner wall surface 53 of the injector body casing 52 and the outer surface 66 of the tip component 65.

In the embodiment shown in FIGS. 1 and 2, the injector stack component 85 may be a guide piece 58. The nozzle chamber 61 is defined by the inner wall surface 69 of the high-pressure containment sleeve 70, the top surface 68 of the tip component 65 and the guide piece 58. In this embodiment, the guide piece 58 is the injector stack component 85 that may guide the needle valve member 78 while it is moving between an open position and a closed position. At all times the needle valve member remains out of contact with, or surrounded by, the high-pressure containment sleeve 70 as shown in FIGS. 1 and 2. A nozzle spring 59 biases the needle valve member 78 to the closed position. The needle valve member 78 has an opening hydraulic surface 79 exposed to fluid pressure inside the nozzle chamber 61 and a closing hydraulic surface 82 exposed to pressure in a needle control chamber 80, which is disposed within the nozzle assembly 60. The needle valve member 78 is partially disposed inside the bore 62 of the tip component 65 and slidably moves within the bore 62. The needle valve member 78 may be made from a plurality of pieces, but the illustrated embodiment shows a unitary construction that includes a lower valve member 89 and a guide segment 84. The guide segment 84 may be located on the needle valve member 78 and may guide the needle valve member 78 along the bore reducing the risk of misaligning the needle valve member 78 with the bore 62 of the tip component 65, and therefore allowing the nozzle outlet 64 to open and close more accurately.

The nozzle chamber 61 is fluidly connected to a rail inlet port 14 of the fuel injector 10 via a fuel supply passage 41 that opens into nozzle chamber 61 at a location offset from a centerline of the high pressure containment sleeve 70 as shown in FIGS. 1 and 2. The nozzle chamber 61 allows high-pressure fuel entering into the rail inlet port 14 to enter through the fuel supply passage 41 into the nozzle chamber 61. A pressure communication passage 42 fluidly connects the nozzle chamber 61 to the control valve assembly 30. The pressure communication passage 42 is also fluidly connected to the needle control chamber 80 via a first flow restrictor 46 that extends between the pressure communication passage 42 and the needle control chamber 80.

The control valve assembly 30 includes a control valve member 31 that moves between a lower valve seat 37 and an upper valve seat 36. The control valve assembly 30 may be electrically actuated by a solenoid coil 25, which controls the movement of an armature assembly 20 between a first armature position and a second armature position. The control valve assembly 30 is fluidly connected to the needle control chamber 80 via a valve supply passage 43 and a second flow restrictor 47. The second flow restrictor 47 is fluidly connected to the needle control chamber 80, and the flow area of the second flow restrictor 47 may be greater than the flow area of the first flow restrictor 46.

The control valve assembly 30 may fluidly connect the valve supply passage 43 to a low pressure drain or to the pressure communication passage 42, depending on whether the control valve member 31 is seated at the upper valve seat 36 or lower valve seat 37, respectively.

Typically, the nozzle chamber 61 and the pressure communication passage 42 are always at high-pressure as there is an unobstructed fluid connection with the common rail (not shown) through the rail inlet port 14. However, the pressure inside the needle control chamber 80 varies between high-pressure and low-pressure. When the solenoid coil 25 is de-energized, the armature assembly 20 is in the first armature position and the control valve member 32 is seated at the lower valve seat 37. The pressure communication passage 42 is fluidly connected to the valve supply passage 43, which in turn is connected to the needle control chamber 80 via the second flow restrictor 47. The pressure communication passage 42 is continuously supplying high-pressure fuel to the needle control chamber 80 via the first flow restrictor 46 and therefore, the needle control chamber 80 is exposed to high-pressure fuel when the solenoid coil 25 is de-energized. When the solenoid coil 25 is energized, the armature assembly 20 moves to the second armature position and the control valve member 32 is seated at the upper valve seat 36. The fluid connection between the pressure communication passage 42 and the valve supply passage is now blocked. Instead, the valve supply passage 43 is now fluidly connected to a low-pressure drain (not shown), allowing fuel from the needle control chamber 80 to flow to the low-pressure drain. As the second flow restrictor 47 has a larger flow area than the first flow restrictor 46, more fuel leaves the needle control chamber 80 than the amount of fuel entering, hence reducing the pressure inside the needle control chamber 80.

Figure 3:
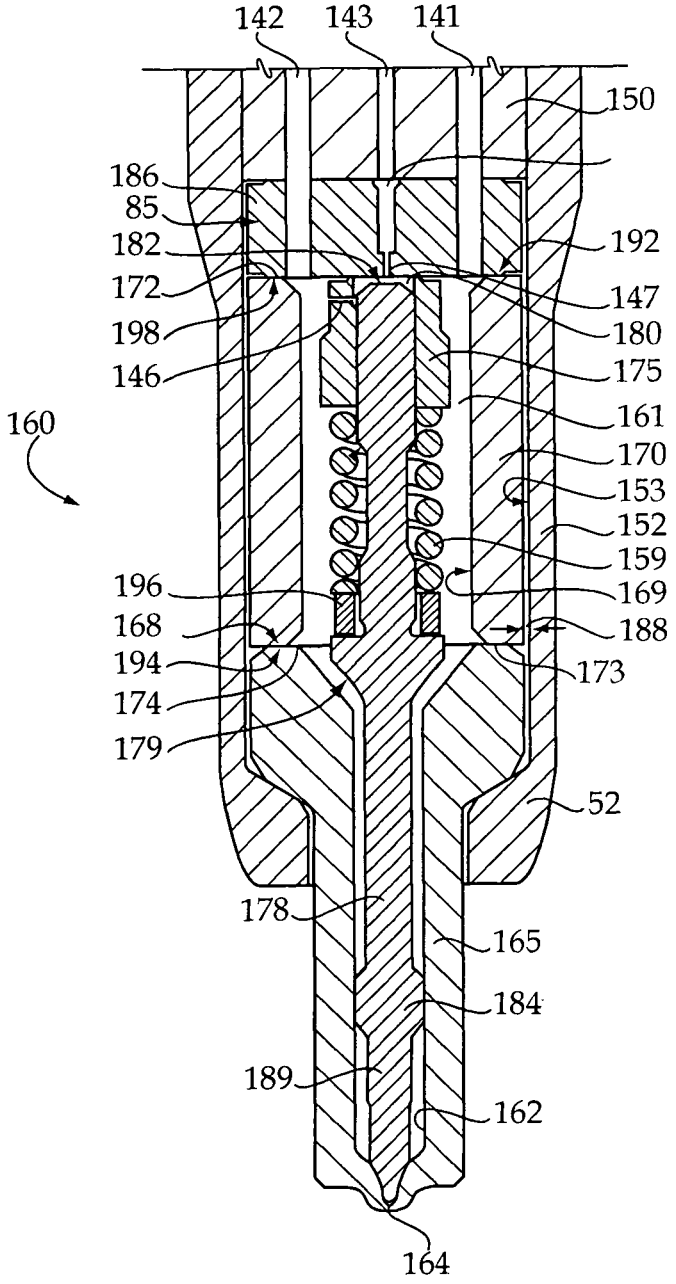
FIG. 3 shows an enlarged sectioned view of a nozzle assembly of a fuel injector according to another embodiment of the present disclosure.

Referring to FIG. 3, another embodiment of a nozzle assembly 160 is shown. Numbers that appear in FIG. 3 that similar to those in FIGS. 1 and 2, such as 72 and 172 or 74 and 174 may be used to show that they represent similar items.

Referring generally to FIGS. 1, 2 and 3, those skilled in the art may appreciate that a nozzle assembly may come in various shapes and forms. FIGS. 1 and 2 show one embodiment of the nozzle assembly 60, where there is no control orifice component 186 and the needle control chamber 80 is isolated from the nozzle chamber 61 by an injector stack component 85. FIG. 3 shows a nozzle assembly 160 of another embodiment of a fuel injector 100 where the needle control chamber 180 is partially defined by a control orifice component 186 and a floating check guide 175. The nozzle assembly 160 includes a high-pressure containment sleeve 170, which is disposed within an injector body casing 153, and is in sealed contact with an injector stack component 185 and a tip component 165. The high-pressure containment sleeve 170 may be a check lift sleeve 170. The check lift sleeve 170, the injector stack component 85 and the tip component 165 define a nozzle chamber 161, in which a needle valve member 178 is movably positioned. In one embodiment, a nozzle spring 159 biases the needle valve member 178 to a closed position. A nozzle spring spacer 196 may set a preload on the nozzle spring 159.

The check lift sleeve 170 has an outer wall surface 171, an inner wall surface 169, a top surface 192 and a bottom surface 194. The check lift sleeve 170 has a hollow, cylindrical shape, which means the check lift sleeve 170 is cylindrical in shape and has a hollow interior bore through the top and bottom surfaces 192 and 94 of the check lift sleeve 170. The check lift sleeve 170 has a wall thickness defined by the difference between the radius of the outer wall surface 171 and the radius of the inner wall surface 169 of the check lift sleeve 170. The wall thickness of the check lift sleeve 170 is designed to accommodate expected hoop stresses from expected pressure levels in the check lift sleeve 170. Those skilled in the art appreciate that hoop stress may be the greatest towards the mid-section of the check lift sleeve 170, therefore, the thickness of the check lift sleeve 170 is determined from the thickness at the mid-section of the check lift sleeve 170. Although the thickness of the check lift sleeve 170 may vary throughout its length, it may be easier to manufacture a check lift sleeve 170 with a uniform thickness. In one embodiment, the check lift sleeve 170 has a uniform wall thickness along a majority of the length of the check lift sleeve 170, which means that the wall thickness remains the same for more than half of the length of the check lift sleeve 170.

In one embodiment, the check lift sleeve 170 includes an upper sealing land 172 located on the top surface 192 of the check lift sleeve 170 and a lower sealing land 173 located on the bottom surface 194 of the check lift sleeve 170. The upper and lower sealing lands 172 and 173 may be annular, and have a radial surface width smaller than the thickness of the wall of the check lift sleeve 170. The term radial surface width is defined as the difference between the radius of an outer edge of the sealing land and the radius of an inner edge of the sealing land. Those skilled in the art may appreciate that by having the radial surface width of the sealing lands 172 and 173 smaller than the wall thickness of the check lift sleeve 170, the clamping pressure acting on the sealing lands 172 and 173 will be greater, therefore, producing better sealing. In one embodiment of the disclosure, the top surface 192 and the bottom surface 194 of the check lift sleeve 170 may have chamfers 174, which also result in the sealing lands 172 and 173 having a smaller radial surface width compared to the wall thickness of the check lift sleeve 170 at the mid-section of the check lift sleeve 70. The bottom surface 194 of the check lift sleeve 170 and a top surface 168 of the tip component 165 are in contact and form a seal to prevent fluid from leaking out of the nozzle chamber 161.

The outer wall surface 171 of the check lift sleeve 170 is separated from the inner wall 153 of the injector body casing 152 by a space. The space between the outer wall surface 171 of the check lift sleeve 170 and the inner wall 153 of the injector body casing 152 defines a leakage path 188. The leakage path 188 runs along the inner wall 153 of the injector body casing 152 into a drain outlet port (not shown) of the fuel injector 100.

In addition to the check lift sleeve 170, the nozzle assembly 160 includes the tip component 165 that includes an outer wall 166, a top surface 168, a bottom end 167, which defines a nozzle outlet 164. A bore 162 is defined within the tip component 165 and runs from the top surface 168 of the tip component 165 towards the bottom end 167 of the tip component 165, where it opens up into the nozzle outlet 164. The tip component 165 is partially disposed within the injector body casing 152, and the outer wall 166 of the tip component 165 may form a sealing contact 156 with the injector body casing 152, preventing any fuel that enters into the leakage path 188 to escape from between the inner wall surface 153 of the injector body casing 152 and the outer surface 166 of the tip component 165.

In the embodiment shown in FIG. 3, the injector stack component 85 is a control orifice component 186. The nozzle chamber 161 is defined by the inner wall surface 169 of the check lift sleeve 170, the top surface 168 of the tip component 165 and a bottom surface 198 of the control orifice component 186. In this embodiment, a floating check guide 175 is biased into contact with the bottom surface 198 of the control orifice component 186 by the nozzle spring 159. The floating check guide 175 may guide the needle valve member 178 while it is moving between an open position and a closed position. The needle valve member 178 always remains out of contact with, but surrounded by, the check lift sleeve 170 as shown in FIG. 3. A nozzle spring 159 also biases the needle valve member 178 to the closed position. The needle valve member 178 has an opening hydraulic surface 179 exposed to fluid pressure inside the nozzle chamber 161 and a closing hydraulic surface 182 exposed to a needle control chamber 180, which is disposed within the nozzle assembly 160. The needle valve member 178 is partially disposed inside the bore 162 of the tip component 165 and slidably moves within the bore 162. The needle valve member 178 may be made from a plurality of pieces, including a lower valve member 189, which may be in contact with a guide segment 184. The guide segment 184 may be located on the needle valve member 178 and may guide the needle valve member 78 along the bore reducing the risk of misaligning the needle valve member 178 with the bore 162 of the tip component 165, and therefore allowing the nozzle outlet 164 to open and close more accurately.

This nozzle assembly 160 is a part of a fuel injector 100 (partially shown in FIG. 3) contains many similar features to the nozzle assembly 60 shown in FIGS. 1 and 2, but differs slightly from the nozzle assembly 60 shown in FIGS. 1 and 2 in that the nozzle chamber 161 is defined by the inner wall surface 169 of the check lift sleeve 170, the top surface 168 of the tip component 165 and the bottom surface 198 of the orifice control component 186. Further, the floating check guide 175 defines a first flow restrictor 146 and the floating check guide 175 along with the needle valve member 178 and the bottom surface 198 of the orifice control component 186 define a needle control chamber 180. A nozzle spring spacer 196 may be used to set the preload of the nozzle spring 159. In one embodiment, the needle control chamber 180 and the nozzle chamber 161 are fluidly connected through a first flow restrictor 146, which is defined within the floating check guide 75. In contrast to the embodiment shown in FIG. 3, the embodiment shown in FIG. 2 shows the first flow restrictor 46 fluidly connects the needle control chamber 80 to the pressure communication passage 42.

It may further be appreciated by those skilled in the art that this disclosure relates to a nozzle assembly 60 that may be implemented into a wide variety of fuel injectors. The disclosure herein may pertain to certain types of fuel injectors, such as, common rail fuel injectors. However, the scope of the disclosure is not intended to be limited to the embodiments described herein, but rather to all embodiments that fall within the spirit of this disclosure.

Industrial Applicability

The present disclosure finds potential application in fuel injectors and fuel systems in any engine or machine. The present disclosure has a general applicability in fuel injectors used in smaller engines and a particular applicability in smaller sized fuel injectors operating at higher pressures, such as above 200 MPa.

The nozzle assemblies 60 and 160 described in this disclosure may be used to operate any fuel injector. The nozzle assemblies 60 and 160 described in this disclosure may be suitable for common rail fuel injectors that want to achieve higher fuel injection pressures. Those skilled in the art may appreciate the various ways of controlling the flow of fuel through the nozzle outlet via a solenoid actuated valve assembly. The present disclosure describes the sequence of an injection event inside an electrically actuated common rail fuel injector 10, 100 including the nozzle assembly 60, 160 shown in FIGS. 1, 2 and 3. Those skilled in the art may acknowledge that the disclosure describing the sequence of an injection event is not limited only to the embodiments disclosed within but to all other embodiments that fall within the spirit of the disclosure.

An injection event begins from the time the electrical actuator 25 is energized, and ends when the electrical actuator 25 is de-energized. Prior to an injection event, the electrical actuator 25 is de-energized, and the armature assembly 20 is in the first armature position. The control valve member 31 is seated at the lower valve seat 37, thereby allowing the valve supply passage 43, 143 to be fluidly connected to the pressure communication passage 42, 142. The control valve assembly 30 has a first configuration when the needle control chamber 80, 180 is connected to a low-pressure passage and has a second configuration when the needle control chamber 80, 180 is blocked from the low-pressure passage. During this period, fuel enters the fuel injector 10 through the rail inlet port 14 and enters the nozzle chamber 61, 161 through the fuel supply passage 41, 141. The nozzle chamber 61, 161 contains high-pressure fuel, which is exerted on the opening hydraulic surface 79. 179 of the needle valve member 78, 178. In the embodiment shown in FIG. 2, the high-pressure fuel flows through the pressure communication passage 42 and into the needle control chamber 80 through the first flow restrictor 46. However, in the embodiment of FIG. 3, the high-pressure fuel flows through the nozzle chamber 161 into the needle control chamber 186 via the first flow restrictor 146. When the control valve member 31 is in the lower valve seat 37, fuel from the pressure communication passage 42, 142 may move into the valve supply passage 43, 143 and into the needle control chamber 80, 180 also via the second flow restrictor 47, 147. The control valve 30 is in the first configuration when the needle control chamber 80, 180 is fluidly blocked from the low-pressure drain. Because there is high-pressure fuel inside the needle control chamber 80, 180 the closing hydraulic surface 82, 182 is also exposed to high-pressure. This pressure combined with the preload of the nozzle spring 59, 159 holds the needle valve member 78, 178 in the closed position, thereby not allowing any fuel from the nozzle chamber 61, 161 to leak out of the nozzle outlet 64, 164. Fuel inside the nozzle chamber 61, 161 is at high-pressure and the upper sealing lands 72, 172 and lower sealing lands 73, 172 of the high-pressure containment sleeve 70, 170 prevent the fuel from leaking into the leakage path 88, 188. Leakage that may occur from the nozzle chamber 61, 161 to the leakage path 88, 188 may flow to the drain port because it is at a lower pressure.

As the electrical actuator 25 is energized, the armature assembly 20 moves from the first armature position to the second armature position. The control valve member 31 also moves from the lower valve seat 37 to the upper valve seat 36, where it remains until the actuator 25 is de-energized. Fuel from the valve supply passage 43, 143 may flow through the lower valve seat 37 into a low-pressure drain (not shown) instead of through the upper valve seat 36 to the pressure communication passage 42, 142. Fuel may continue to move into the needle control chamber 80, 180 from the first flow restrictor 46, 146, but because the valve supply passage 43 is now connected to the low pressure drain, high-pressure fuel moves from the needle control chamber 80, 180 to the drain via the second flow restrictor 47, 147 and the valve supply passage 43, 143 because the second flow restrictor 47, 147 has a larger flow area than the first flow restrictor 46. The needle control chamber 80, 180 now may have a lower pressure and subsequently, lower pressure is acting on the closing hydraulic surface 82, 182 of the needle valve member 78, 178.

When the actuator 25 is energized and the needle control chamber 80, 180 has lower pressure, the force acting upon the opening hydraulic surface 79, 179 of the needle valve member 78, 178 exceeds the preload of the nozzle spring 59, 159 and the force acting upon the closing hydraulic surface 82, 182. Relieving the pressure acting on the closing hydraulic surface 82, 182 of the needle valve member 78, 178 inside the needle control chamber 80, 180 allows the needle valve member 78, 178 to move to the open position, allowing the nozzle outlet 64, 64 to open. In one embodiment, the closing hydraulic surface 82, 182 of the needle valve member 78, 178 does not touch the injector stack component 85, 185 because the interaction between the first and second flow restrictors 46, 146 and 47, 147 hydraulically stops the needle valve member 78, 178 before it hits the injector stack component 85, 185. In the nozzle assembly 60 shown in FIG. 2, the injector stack component 85 is the guide piece 58, while in the nozzle assembly in FIG. 3, the injector stack component 85 is the control orifice component 186. Fuel from the nozzle chamber 61, 161 flows through the nozzle outlet 64, 164 until the nozzle outlet 64, 164 is closed again. When the actuator 25 is energized, the control valve 30 is in the second configuration fluidly connecting the needle control chamber 80, 180 to the low-pressure drain.

The needle valve member 78, 178 is guided via an interaction between the needle valve member 78, 178 and the tip component 65, 165. In one embodiment, the guide segment 84, 184 of the needle valve member 78, 178 guides the needle valve member 78, 178 along the bore 62, 162 of the tip component 65, 165, and the guide segment 84, 184 may prevent the needle valve member 78, 178 from being misaligned with the bore 62, 162 of the tip component 65, 165. Those skilled in the art will understand the importance of maintaining the alignment of the needle valve member 78, 178 with respect to the bore 62, 162 of the tip component 65, 165 and the nozzle assembly 60, 160 because maintaining alignment between the bore 62, 162 and the needle valve member 78, 178 will reduce wear and tear caused by rubbing the needle valve member 78, 178 against the bore 62, 162 as well as improve the accuracy at which the nozzle outlet 64, 164 is opened and closed.

In order to end the injection event, the nozzle outlet 64, 164 is closed by de-energizing the actuator 25. When the actuator 25 is de-energized, the armature assembly 20 moves from the second armature position to the first armature position, consequently moving the control valve member 31 from the upper valve seat 36 back to the lower valve seat 37. Once the control valve member 32 is at the lower valve seat 37, the fluid connection between valve supply passage 43, 143 and the low pressure drain is now disconnected. Instead, the valve supply passage 43, 143 is once again fluidly connected to the pressure communication passage 42, 142 allowing high-pressure fuel from the pressure communication passage 42, 142 to flow to the valve supply passage 43, 143. In the nozzle assembly 60 shown in FIG. 2, fuel from the pressure communication passage 42 fills the needle control chamber 80 with high-pressure fuel since high-pressure fuel is entering the needle control chamber 80 through both the first flow restrictor 46 and second flow restrictor 47. In the nozzle assembly 160 shown in FIG. 3, fuel from the nozzle chamber 161 enters the needle control chamber 180 via the first flow restrictor 146 and fuel from the pressure communication passage 142 enters the needle control chamber 180 via the second flow restrictor 147. High pressure inside the needle control chamber 80, 180 acts on the closing hydraulic surface 82, 182 of the needle valve member 78, 178 causing the needle valve member 78, 178 to move to its closed position from the open position. Thereby, the nozzle outlet 64, 164 is closed and the injection event is terminated.

Those skilled in the art will also appreciate that the pressure inside the nozzle chamber 61, 161 is dependent upon the rail pressure. Further, because there is an unobstructed fluid connection between the rail inlet port 14 and the nozzle chamber 61, 161 and the nozzle outlet's 64, 164 flow area is smaller than the flow area of the fuel supply passage 41, 141, the nozzle chamber 61, 161 maintains high-pressure both during and between injection events.

Also, the sealing lands 72, 172 and 73, 173 of the high-pressure containment sleeve 70, 170 may be annular and may be smaller in width than the wall thickness of the high-pressure containment sleeve 70, 170. The sealing lands 72, 172 and 73, 173 prevent the high-pressure fuel from leaking into the leakage path 88, 188. Because the components of the fuel injector 10, 100 are clamped together to contain the fuel pressure, the forces are exerted on the respective components of the fuel injector 10, 100. By reducing the surface area of the sealing lands of the components, the pressure is increased on the surface of the sealing land allowing for better sealing capabilities.

Referring to FIG. 3, a nozzle assembly 160 of a fuel injector 100 according to another embodiment of the present disclosure is shown. The nozzle assembly 160 is similar to the nozzle assembly 60 shown in FIGS. 1 and 2, except for a few differences in structure. The nozzle assembly 160 includes a floating check guide 175, which is in contact with the needle valve member 178, and the bottom surface of the injector stack component 85. In this embodiment, the control orifice component 186 is one embodiment of the injector stack component 85. The floating check guide 175 is biased to be in flat seat sealing contact with the control orifice component 186 via the nozzle spring 159.

The floating check guide 175 defines the first flow restrictor 146, which extends between the nozzle chamber 161 and the needle control chamber 180 and thereby maintains an unobstructed fluid connection between the nozzle chamber 61 and the needle control chamber 80 during and between injection events. The second flow restrictor 182 is defined within the control orifice component 186 and extends between the needle control chamber 186 and the valve supply passage 143. Similar to the embodiment shown in FIGS. 1 and 2, the nozzle assembly 160 hydraulically stops the needle valve member after moving the needle valve member from a closed position to an open position. The first flow restrictor 146 fluidly connects the nozzle chamber 61 to the needle control chamber 80, there will always be fluid inside the needle control chamber and therefore, the needle valve member will always have some fluid pressure acting on the closing hydraulic surface. The needle valve member 78 stops when the pressure acting on the closing hydraulic surface 82 and the preload of the spring 59 equal the pressure acting on the opening hydraulic surface 79 of the needle valve member 78 in the nozzle chamber 61.

The nozzle assembly 160 also differs from the nozzle assembly 60 shown in FIGS. 1 and 2 in that the needle control chamber 182 is defined by the floating check guide 175, the control orifice component 186 and the needle valve member 178. The operation of the fuel injector 100 however remains similar to the operation of the fuel injector 10 described with reference to the nozzle assembly 60 shown in FIGS. 1 and 2.

The present disclosure improves a fuel injector's ability to withstand higher injection pressures. By using a high-pressure containment sleeve, with adequate wall thickness and free from stress concentrating surface features, such as those associated with the heart shaped cavity of the prior art, smaller fuel injectors may withstand higher pressures without forming stress fractures. The ease in manufacturing the high-pressure containment sleeve also reduces the manufacturing costs of producing these fuel injectors, as machining a heart shaped cavity surrounded by metal may be more costly. Further, designing the high-pressure containment sleeves with annular sealing lands may provide for a better seal capable of withstanding these higher pressures for a longer injector life.

It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure, and the appended claims.

What is claimed is:

1. A nozzle assembly comprising:

a tip component defining a nozzle outlet;

a high-pressure containment sleeve having a centerline and being disposed within an injector body casing;

the high-pressure containment sleeve and the tip component partially defining a nozzle chamber; a needle valve member movable between a first position that closes the nozzle outlet and a second position that opens the nozzle outlet;

the needle valve member including an opening hydraulic surface exposed to fluid pressure in the nozzle chamber;

the needle valve member is out of contact with, but surrounded by, the high-pressure containment sleeve;

an injector stack component that defines a segment of a fuel supply passage and a portion of the nozzle chamber; and the injector stack component also defines a pressure communication passage that terminates at a portion of the nozzle chamber surrounded by the high-pressure containment sleeve, wherein the segment of the fuel supply passage opens into the nozzle chamber offset from the centerline; wherein the high-pressure containment sleeve has a wall thickness at a middle section;

the high-pressure containment sleeve includes an annular sealing land having a radial surface width smaller than the wall thickness;

wherein the sealing land is in contact with the tip component.

2. The nozzle assembly of claim 1, wherein the high-pressure containment sleeve has a hollow, cylindrical shape.

3. The nozzle assembly of claim 1, further includes a needle control chamber partially defined by one needle valve member;

the needle valve member having a closing hydraulic surface exposed to pressure in the needle control chamber.

4. The nozzle assembly of claim 1, wherein the high-pressure containment sleeve has a uniform wall thickness over a majority of a length of the high-pressure containment sleeve.

5. The nozzle assembly of claim 1, wherein:

the high-pressure containment sleeve is hollow and has a uniform wall thickness over a majority of a length of the high-pressure containment sleeve; and the high-pressure containment sleeve includes a second annular sealing land having a radial surface width smaller than the uniform wall thickness, wherein the second sealing land is in contact with the injector stack component.

6. A fuel injector comprising:

an injector body including:

a tip component defining a nozzle outlet;

a high-pressure containment sleeve disposed within an injector body casing;

the high-pressure containment sleeve and the tip component partially defining a nozzle chamber;

a needle valve member disposed within the injector body, movable between a first position that closes the nozzle outlet and a second position that opens the nozzle outlet;

the needle valve member including an opening hydraulic surface exposed to fluid pressure in the nozzle chamber and a closing hydraulic surface exposed to fluid pressure in a needle control chamber;

the needle valve member is out of contact with, but surrounded by, the high-pressure containment sleeve;

a control valve assembly fluidly connected to the needle control chamber;

an electrical actuator operably coupled to the control valve assembly;

an injector stack component that defines a segment of a fuel supply passage and a portion of the nozzle chamber and the injector stack component also defines a pressure communication passage that terminates at a portion of the nozzle chamber surrounded by the high-pressure containment sleeve wherein the segment of the fuel supply passage opens into the nozzle chamber offset from a centerline of the nozzle chamber;

a floating check guide disposed in the nozzle chamber;

the floating check guide partially defines the needle control chamber; and the float check guide is out of contact with the high-pressure containment sleeve.

7. The nozzle assembly of claim 6, wherein the high-pressure containment sleeve has a wall thickness at a middle section;

the high-pressure containment sleeve includes an annular sealing land having a radial surface width smaller than the wall thickness; wherein the sealing land is in contact with the tip component.

8. The nozzle assembly of claim 7, wherein the needle control chamber is partially defined by one end of the needle valve member.

9. The nozzle assembly of claim 8, wherein the high-pressure containment sleeve has a uniform wall thickness over a majority of a length of the high-pressure containment sleeve.

10. A fuel injector comprising:

an injector body including:

a tip component defining a nozzle outlet;

a high-pressure containment sleeve disposed within an injector body casing;

the high-pressure containment sleeve and the tip component partially defining a nozzle chamber;

a needle valve member disposed within the injector body, movable between a first position that closes the nozzle outlet and a second position that opens the nozzle outlet, the needle valve member including an opening hydraulic surface exposed to fluid pressure in the nozzle chamber and a closing hydraulic surface exposed to fluid pressure in a needle control chamber;

the needle valve member is out of contact with, but surrounded by, the high-pressure containment sleeve;

a control valve assembly fluidly connected to the needle control chamber;

an electrical actuator operably coupled to the control valve assembly;

an injector stack component that defines a segment of a fuel supply passage and a portion of the nozzle chamber and the injector stack component also defines a pressure communication passage that terminates at a portion of the nozzle chamber surrounded by the high-pressure containment sleeve wherein the segment of the fuel supply passage opens into the nozzle chamber offset from a centerline of the nozzle chamber;

a floating check guide disposed in the nozzle chamber;

the floating check guide partially defines the needle control chamber; and the floating check guide is out of contact with the high-pressure containment sleeve, wherein the control valve assembly having a first configuration wherein the needle control chamber is fluidy connected to a low pressure passage;

the control valve assembly having a second configuration wherein the needle control chamber is blocked from the low pressure passage; and the electrical actuator is a solenoid actuator operably coupled to move the control valve assembly from the second configuration to the first configuration when energized.

* * * * *